United States Patent [19]

Fujita

[11] Patent Number: 5,074,781

[45] Date of Patent: Dec. 24, 1991

[54] CIGARETTE LIGHTER

[75] Inventor: Shozo Fujita, Yokohama, Japan

[73] Assignee: Pollyflame Japan Ltd., Tokyo, Japan

[21] Appl. No.: 685,511

[22] Filed: Apr. 15, 1991

[30] Foreign Application Priority Data

Oct. 22, 1990 [JP] Japan ..... 2-109706[U]

[51] Int. Cl.[5] ..... F23D 11/36

[52] U.S. Cl. ..... 431/153; 431/277

[58] Field of Search ..... 431/153, 276, 277

[56] References Cited

U.S. PATENT DOCUMENTS 5,002,482 3/1991 Fairbanks et al. ..... 431/153

FOREIGN PATENT DOCUMENTS 296281 12/1988 European Pat. Off. .

WO90/00239 1/1990 World Int. Prop. O. .

*Primary Examiner*—Carroll B. Dority

*Attorney, Agent, or Firm*—Burgess, Ryan & Wayne

[57] ABSTRACT

A cigarette lighter with high operability and safety is proposed. According to this lighter, when a lock member is rotated in a lighting operation, the lock member is automatically moved to a position to allow the movement of an operating member upon reception of an upward pressure from a spring. When the operating member is moved after the lighting operaton, the lock member is moved to a position to inhibit the movement of the operating member upon reception of a rotary biasing force from the spring, thus automatically locking a lighting operation of the operating member while the lighter is not used.

6 Claims, 3 Drawing Sheets

CIGARETTE LIGHTER

BACKGROUND OF THE INVENTION

I. Field of the Invention

The present invention relates to a cigarette lighter including a device for locking an operation of an operating member for performing a lighting operation while the lighter is not used.

II. Description of the Prior Art

A certain type of conventional lighting device, e.g., a cigarette lighter, has a safety device for locking an operation of an operating member for performing a lighting operation so as to prevent an unintentional operation of this operating member. The safety device is effectively used to prevent an unintentional operation of the operating member in, e.g., a pocket, which is caused by an external force while it is carried. In addition, the safety device is effectively used to prevent an unintentional operation of the operating member, which is caused when the cigarette lighter is taken out of a pocket, and the operating member catches part of clothes, and to prevent an infant from accidentally performing a lighting operation to cause an accident.

In the above-described prior art, however, in order to allow the safety device to lock an operation of the operating member and to allow the cigarette lighter to perform a normal light operation, the safety device must be moved between a position to lock an operation of the operating member and a position to allow an operation of the operating member. Therefore, a user is required to perform a special operation, and he or she tends to forget to move the safety device to the operation locking position.

As described above, in a conventional cigarette lighter, a safety device does not satisfactorily function as a safety means.

DISCLOSURE OF THE INVENTION

It is a principal object of the present invention to provide a cigarette lighter having a simple arrangement and excellent operability, which can reliably prevent an unintentional lighting operation of an operating member.

In order to achieve the above object, according to the present invention, there is provided a cigarette lighter comprising an operating member which is moved to perform a lighting operation, a lock member which can be moved to a position to inhibit movement of the operating member and to a position to allow movement thereof, a lock portion for locking the lock member to the position to allow movement of the operating member, and a spring for applying an upward pressure onto the lock member to move the lock member toward the lock portion, and applying a rotary biasing force to the lock member, which is disengaged from the lock portion upon movement of the operating member, to move the lock member to a position to inhibit movement of the operating member.

According to the above-described arrangement, when the lock member is locked to the lock portion, a lighting operation of the operating member can be performed. After the operating member is moved in this state to perform a lighting operation, the lock member is disengaged from the lock portion by the operating member and is automatically moved, by the spring, to the position where the operating member can be held not to be moved.

In addition, the lock member is designed to receive a biasing force from the single spring to be reliably held at the position to be locked by the lock member and at the position to lock the movement of the operating member.

The above and other objects, features, and advantages of the present invention will be apparent from the following detailed description of an embodiment in conduction with the accompanying drawings.

BEST MODE OF CARRYING OUT THE INVENTION

Figure 1:
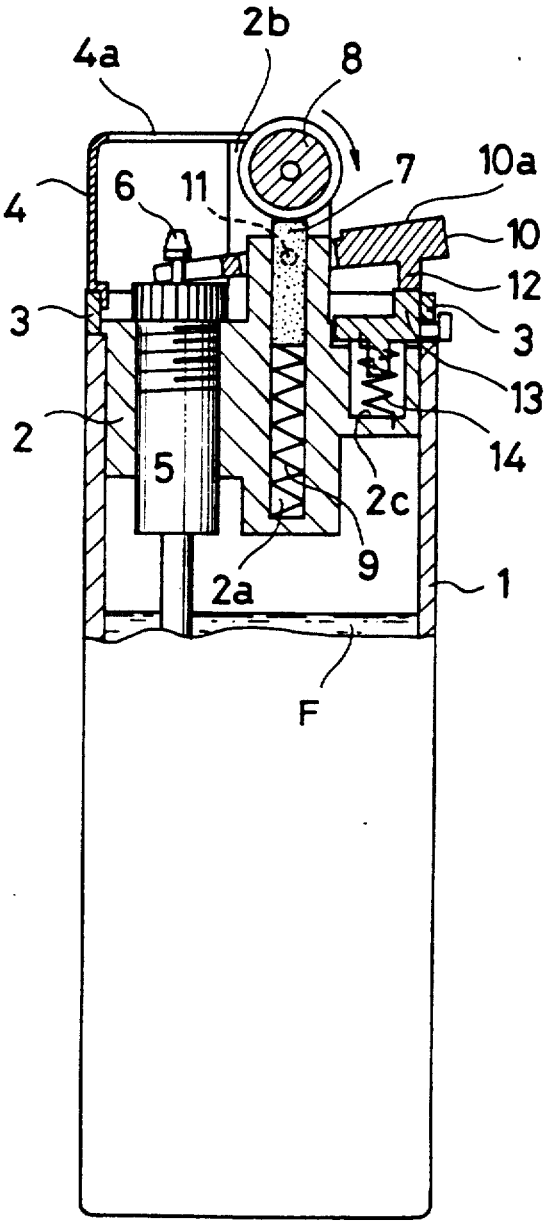
FIG. 1 is a sectional front view showing a cigarette lighter according to an embodiment of the present invention.

FIG. 1 is a partial sectional front view of an embodiment of the present invention. Referring to FIG. 1, reference numeral 1 denotes a fuel tank in which a fuel F is stored; 2, a lid member for closing an upper opening of the fuel tank 1; 3, an outer casing fixed to an upper peripheral portion of the lid member 2; 4, a windshield member fixed to an upper left portion of the outer casing 3 and having a lighting opening 4*a*; 5, a valve unit fixed to a left portion of the lid member 2; 6, a gas jet nozzle arranged on the valve unit 5 so as to be vertically movable; 7, a flint stored in a storage hole 2*a* formed in a central portion of the lid member 2; 8, a filing roller rotatably supported by a support wall 2*b* protruding from the lid member 2; 9, a press spring, stored in the storage hole 2*a*, for pressing the flint 7 against the filing roller 8; 10, a rotatable operating member having one end engaged with the gas jet nozzle 6, the other end formed with a finger press portion 10*a*, and a central portion supported by a shaft 11; 12, a lock projection extending from a bottom portion of the operating member 10; 13, a lock member (to be described later), arranged on the lid member 2 below the lock projection 12; and 14, a return spring which is engaged with a bottom portion of a storage recess 2*c* of the lid member 2 and with a bottom portion of the lock member 13 so as to press the lock member 13 upward and to bias it to rotate it in one direction.

Figure 2:
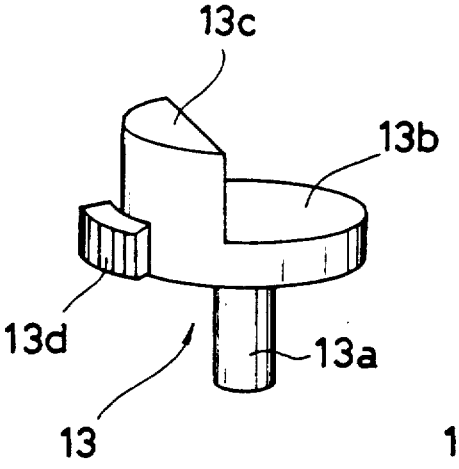
FIG. 2 is a perspective view of a lock member in FIG. 1.

FIG. 2 is a perspective view of the lock member in FIG. 1. The lock member 13 comprises a depending leg portion 13*a*, an upper flat portion 13*b*, an upper projection 13*c*, and an operating projection 13*d*.

Figure 3:
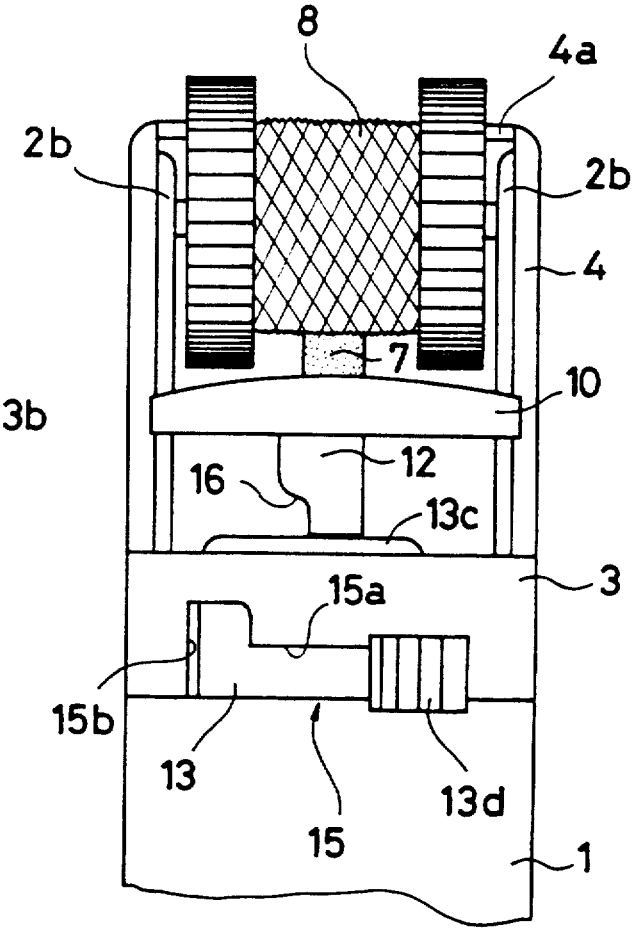
FIG. 3 is a right side view showing a main part of the embodiment in FIG. 1.

FIG. 3 is a right side view showing a main part of the first embodiment. The operating projection 13*d* of the lock member 13 protrudes from a substantially L-shaped guide hole 15 formed on a side portion of the outer casing 3 and constituted by a horizonal portion 15*a* and a vertical portion 15*b* as a lock portion. An inclined portion 16 is formed on a lower side portion of the lock projection 12 of the operating member 10.

An operation of the above embodiment will be described below.

A lighting operation is performed by the following known method. When the filing roller 8 is rotated clockwise in FIG. 1, sparks are generated by friction between the filing roller 8 and the flint 7. With rotation of the filing roller 8, the finger press portion 10*a* is pressed, and the left end of the operating member 10, which is rotated clockwise about the shaft 11, raises the gas jet nozzle 6 to jet the gasified fuel F. As a result, the jetted fuel is ignited by the sparks, and a flame is generated at the lighting opening 4*a* of the windshield member 4.

FIGS. 1 and 3 show a state wherein the operating member is locked. Referring to FIG. 3, the operating projection 13*d* of the lock member 13 is at the position of the horizontal portion 15*a* of the guide hole 15 and is rotationally biased/held against/on a right end portion of the horizontal portion 15*a* by the return spring 14 not to be vertically moved. In this state, the upper projection 13*c* of the lock member 13 is in contact with a lower end portion of the lock projection 12 of the operating member 10, thus inhibiting the movement of the operating member 10.

Figure 4:
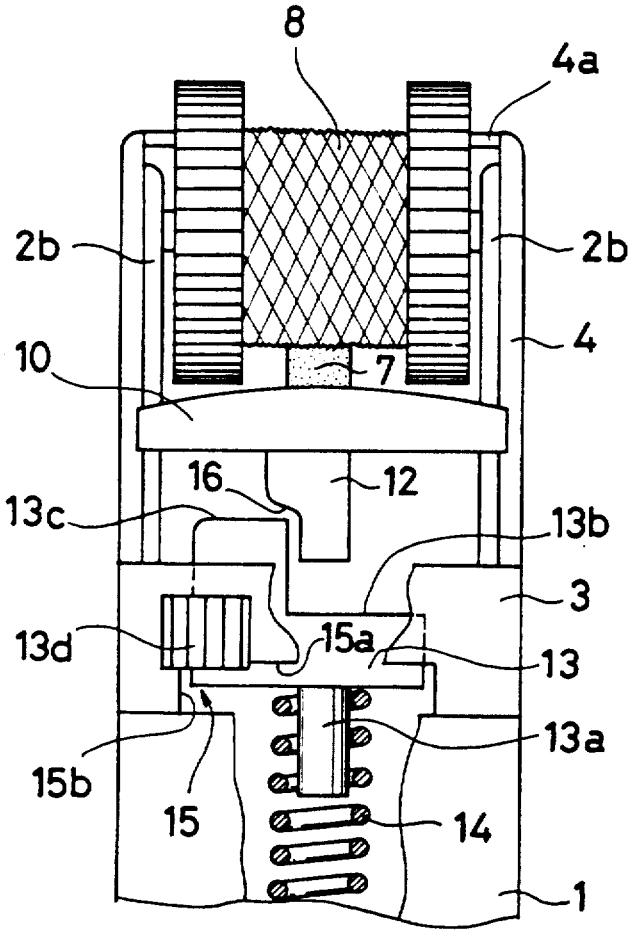
FIG. 4 is a partially cutaway right side view showing a lock release state in FIG. 3.

FIG. 4 is a partially cutaway right side view showing a state wherein the lock state of the operating member is released. When the operating projection 13*d* of the lock member 13 is moved toward the vertical portion 15*b* of the guide hole 15 against the rotary biasing force of the return spring 14, the operating projection 13*d* raises the vertical portion 15*b* as the lock portion upon reception of the upward pressure of the return spring 14. Subsequently, the operating projection 13*d* is locked to an upper portion of the vertical portion 15*b* upon reception of the upward pressure and rotary biasing force of the return spring 14. In this state, the upper flat portion 13*b* of the lock member 13 opposes a lower end portion of the lock projection 12 of the operating member 10, and the operating member 10 can be moved to allow the above-mentioned lighting operation.

When a lighting operation is performed, and the operating member 10 is lowered, the inclined portion 16 of the lock projection 12 of the operating member 10 pushes the upper projection 13*c* downward to move the lock member 13 downward as a whole. When the operating projection 13*d* of the lock member 13 is moved from the vertical portion 15*b* of the guide hole 15 to the horizontal portion 15*a*, the operating projection 13*d* is moved to the right end portion of the horizontal portion 15*a* upon reception of the rotary biasing force of the return spring 14. As a result, the operating projection 13*d* is held at the position to inhibit the movement of the operating member 10 again, as shown in FIG. 3.

As has been described above, according to the present invention, after a lighting operation, the operating member and the spring move the lock member to the position where it can hold the operating member while inhibiting its movement. In addition, the lock member can be reliably held, by a single spring, at the position to allow the movement of the operating member and at the position to inhibit it. With a simple arrangement, therefore, an unintentional lighting operation can be reliably prevented while an easy lighting operation is ensured, and the operability and safety of the cigarette lighter can be improved.

What is claimed is:

1. A cigarette lighter comprising:

an operating member and means for pivotably mounting said operating member to perform a lighting operation;

a lock member including means wherein it can be moved to a position to inhibit movement of said operating member and to a position to allow movement thereof;

means forming a lock portion for locking said lock member to a position to allow movement of said operating member; and means including a spring for applying an upward pressure onto said lock member to move said lock member toward said lock portion, and means including said spring for applying a rotary biasing force to said lock member and for disengaging said lock member from said lock portion upon movement of said operating member in a direction of said lighting operation, to move said lock member to a position to inhibit movement of said operating member.

2. A cigarette lighter of claim 1 wherein the means forming the lock portion comprises a means for slidably engaging said lock member.

3. A cigarette lighter of claim 2 wherein the means forming the lock portion comprises a slot in the lighter for slidably engaging said lock member.

4. A cigarette lighter of claim 1 wherein said lock member comprises a rotatably mounted member having means for blocking movement of the operating member when in a first position and means to rotate the rotatably mounted member to a second position wherein movement of the operating member is not blocked.

5. A cigarette lighter of claim 2 wherein said lock member comprises a rotatably mounted member having means for blocking movement of the operating member when in a first position and means to rotate the rotatably mounted member to a second position wherein movement of the operating member is not blocked.

6. A cigarette lighter of claim 5 wherein said rotatably mounted member comprises means for slidably engaging said lock portion.

* * * * *